US010859272B2

(12) United States Patent
Sadasivuni

(10) Patent No.: US 10,859,272 B2
(45) Date of Patent: Dec. 8, 2020

(54) COMBUSTOR FOR A GAS TURBINE

(71) Applicant: Siemens Aktiengesellschaft, Munich (DE)

(72) Inventor: Suresh Sadasivuni, Lincoln (GB)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 238 days.

(21) Appl. No.: 16/068,708

(22) PCT Filed: Jan. 13, 2017

(86) PCT No.: PCT/EP2017/050705

§ 371 (c)(1),
(2) Date: Jul. 9, 2018

(87) PCT Pub. No.: WO2017/121872

PCT Pub. Date: Jul. 20, 2017

(65) Prior Publication Data

US 2019/0024901 A1 Jan. 24, 2019

(30) Foreign Application Priority Data

Jan. 15, 2016 (EP) ..... 16151603

(51) Int. Cl.
*F23R 3/34* (2006.01)
*F23R 3/14* (2006.01)
(Continued)

(52) U.S. Cl.
CPC ..... *F23R 3/343* (2013.01); *F23C 7/002* (2013.01); *F23C 7/004* (2013.01); *F23D 11/383* (2013.01);
(Continued)

(58) Field of Classification Search
CPC .. F23R 3/14; F23R 3/286; F23R 3/343; F23D 11/383; F23D 2900/14021; F23D 2900/14701; F23C 7/002; F23C 7/004
See application file for complete search history.

(56) References Cited

U.S. PATENT DOCUMENTS 5,016,443 A * 5/1991 Shimizu ..... F23R 3/14 60/39.23
5,072,581 A * 12/1991 Harshman ..... F02K 7/10 60/740
(Continued)

FOREIGN PATENT DOCUMENTS

EP 0797051 A2 9/1997
EP 0810405 A2 12/1997
(Continued)

OTHER PUBLICATIONS

International Search Report dated Apr. 28, 2017, for PCT/EP2017/050705.

*Primary Examiner* — Gerald L Sung
*Assistant Examiner* — Marc J Amar

(57) ABSTRACT

A combustor for a gas turbine, having a pre-combustion chamber having a peripheral wall around a center axis of the pre-combustion chamber, the peripheral wall has an inner panel and an outer panel and a passage provided between the inner and the outer panels, a swirler which is connected to the pre-combustion chamber for providing pre-combustion chamber with a flow of an oxidant gas, at least a pilot fuel injector, wherein the swirler is connected to the peripheral wall in such a way that a portion of the oxidant gas from the swirler is channeled to the passage, and the pilot fuel injector is connected to the passage for injecting a flow of pilot fuel into the passage.

17 Claims, 4 Drawing Sheets

(51) Int. Cl.
*F23R 3/28* (2006.01)
*F23C 7/00* (2006.01)
*F23D 11/38* (2006.01)

(52) U.S. Cl.
CPC ..... *F23R 3/14* (2013.01); *F23R 3/286* (2013.01); *F23C 2900/07001* (2013.01); *F23D 2900/14021* (2013.01); *F23D 2900/14701* (2013.01)

(56) References Cited

U.S. PATENT DOCUMENTS 5,274,995 A * 1/1994 Homer ..... F02C 3/30 60/39.55
5,319,935 A * 6/1994 Toon ..... F23C 6/047 239/403
5,408,825 A * 4/1995 Foss ..... F23R 3/36 60/39.463
5,515,680 A * 5/1996 Fujimura ..... B01F 5/0405 239/434
5,590,529 A * 1/1997 Joshi ..... F23R 3/38 239/403
5,647,215 A * 7/1997 Sharifi ..... F23D 17/002 60/737
5,657,632 A * 8/1997 Foss ..... F23C 7/004 60/737
5,794,449 A 8/1998 Razdan et al.
5,899,075 A * 5/1999 Dean ..... F23C 7/004 60/737
5,983,642 A * 11/1999 Parker ..... F02C 7/222 60/737
6,161,387 A * 12/2000 Green ..... F23R 3/14 60/742
6,209,325 B1 * 4/2001 Alkabie ..... F23C 6/047 60/737
6,363,726 B1 * 4/2002 Durbin ..... F23R 3/14 60/748
6,367,262 B1 * 4/2002 Mongia ..... F23R 3/14 60/748
6,412,282 B1 * 7/2002 Willis ..... F23C 6/047 60/737
8,596,074 B2 * 12/2013 Nilsson ..... B01F 5/0405 239/434
2002/0020173 A1 * 2/2002 Varney ..... F23C 6/047 60/737
2002/0192615 A1 * 12/2002 Moriya ..... F23R 3/286 431/278
2004/0068973 A1 * 4/2004 Wakabayashi ..... F23R 3/343 60/776
2006/0162337 A1 * 7/2006 Stuttaford ..... F23R 3/343 60/776
2007/0033947 A1 * 2/2007 Rocca ..... F16J 15/3472 277/400
2008/0236165 A1 * 10/2008 Baudoin ..... F16J 15/3472 277/400
2009/0117502 A1 5/2009 Wilbraham
2009/0212501 A1 * 8/2009 Glahn ..... F16J 15/3472 277/400
2012/0167544 A1 * 7/2012 Toronto ..... F23R 3/34 60/39.52
2012/0304649 A1 * 12/2012 Matsuyama ..... F02K 7/10 60/740
2014/0144143 A1 * 5/2014 Sanderson ..... F23C 7/004 60/737
2015/0082797 A1 * 3/2015 Matsuyama ..... F23R 3/343 60/776

FOREIGN PATENT DOCUMENTS

EP 1087178 A1 3/2001
EP 1389713 A1 2/2004
GB 2332509 A 6/1999
GB 2432655 A 5/2007
GB 2444737 A 6/2008
WO WO-2008133695 A1 * 11/2008 ..... F23L 15/04

* cited by examiner

COMBUSTOR FOR A GAS TURBINE

CROSS REFERENCE TO RELATED APPLICATIONS

This application is the US National Stage of International Application No. PCT/EP2017/050705 filed Jan. 13, 2017, and claims the benefit thereof. The International Application claims the benefit of European Application No. EP16151603 filed Jan. 15, 2016. All of the applications are incorporated by reference herein in their entirety.

FIELD OF INVENTION

The present invention relates to a combustor for a gas turbine.

ART BACKGROUND

In such a technical field, a combustor generally comprises a main combustion chamber and a pre-combustion chamber, upstream the main combustion chamber. The pre-combustion chamber comprises a swirler section having a swirler through which a main fuel stream is provided. In the swirler the main fuel is mixed to a non-combustible gas flow comprising an oxidant, for example air. The main fuel stream and the non-combustible gas flow are injected via the swirler into the pre-combustion chamber of the combustor in a generally tangential direction with respect to the centre axis of the combustor.

A pilot fuel is further injected in the pre-combustion chamber for controlling the combustor flame in which the main fuel in burned. The pilot fuel is typically injected by a pilot burner, generally according a direction parallel to the centre axis of the combustor.

The pilot fuel is injected from the pilot burner into the pre-combustion chamber through a plurality of pilot fuel injectors, typically arranged on the pilot burner surface, i.e. the surface separating the pilot burner from the pre-combustion chamber. The main fuel and the pilot fuel may be liquid or gaseous fuel.

The combustion of the pilot fuel is achieved through an oxidant, for example air, first being mixed together with the fuel in the pilot burner.

In known solution, the injected pilot fuel generates a diffusion flame inside the pre-combustion chamber, close to pilot burner surface. This has the main drawback of increasing the local temperature at the pilot burner surface, with the consequence of reducing the life cycle of the pilot burner.

Many solutions have been proposed to the above technical problems. Some of them may involve modifications of the geometry of the injectors, for example of their orientation with respect to the centre axis of the pre-combustion chamber. Other may involve modifications of the geometry of the pre-combustion chamber or of pilot burner surface in order to increase turbulence inside the pre-combustion chamber, thus aiming to better fuel distribution in the mixture of the gas inside the pre-combustion chamber.

U.S. Pat. No. 5,274,995A discloses a combustor dome assembly having a venturi and an auxiliary wall concentric with the venturi to provide an annular passage for channeling or directing a high velocity air jet from a swirler to a combustion chamber associated with a downstream end of the venturi, thereby facilitating the atomization of a film of water flowing along an inner surface of the venturi and out of the downstream end.

GB2432655A discloses combustion apparatus comprises a device mixing fuel with an oxidant, a combustion chamber, a pre-chamber located between the combustion chamber and the device, and a means to supply a gas to the pre-chamber so as to prevent a combustion flame from the combustion chamber attaching itself to an interior surface of the pre-chamber by forming a continuous film of gas over the interior surface.

GB2332509A discloses a fuel/air mixing arrangement for a combustion apparatus e.g. a gas turbine comprises a first swirler means in which air and fuel are mixed to form a fuel/air mixture, a first conduit means to supply a first proportion of said mixture to said combustion apparatus and a second swirler means arranged to receive a second proportion of said mixture and a second conduit means to supply said second proportion from said second swirler means to said combustion apparatus.

GB2444737A discloses a burner for a gas turbine comprises a swirler for providing a swirling mix of air and fuel to a combustion chamber. Swirler comprises a plurality of vanes having a plurality of slots each having an inlet and an outlet and through which air travels. Fuel is supplied to the slots to create the swirling air/fuel mix. A fuel placement device is arranged to deposit fuel in a region of high shear that is created by a low pressure region by the swirler. Fuel placement device may be a prefilming device partitioning airflow into first and second flows and is curved. Fuel to the slots may be a secondary main gas via holes in one side of the vanes and fuel from the fuel placement device may be liquid via holes located in the device and in every other slot.

It is therefore still desirable to provide a new design of the combustor above described, in particular involving the position of the pilot fuel injectors, for limiting temperatures at the pilot burner surface, at the same time without compromising the overall efficiency of the combustor. Inside the combustor, avoiding areas with high temperature has also the positive effect in reducing overall nitrogen oxides (NOx) emissions.

SUMMARY OF THE INVENTION

It may be an objective of the present invention to provide a combustor solving the above described inconveniences experimented in known combustors.

It may be a further objective of the present invention to provide a combustor with a proper fuel distribution in the mixture of the gas inside the pre-combustion chamber, in order to avoid areas with non-desirable high temperature.

This object is solved by a combustor for a gas turbine according to the independent claim. The dependent claims describe advantageous developments and modifications of the invention.

According to an aspect of the present invention, a combustor for a gas turbine is presented. The combustor comprises: a burner plenum inside which an oxidant gas flows, a pre-combustion chamber having a peripheral wall around a centre axis of the pre-combustion chamber, the peripheral wall comprising an inner panel and an outer panel distanced from the inner panel in such a way that a passage is provided between the inner and the outer panels, a swirler which is connected to the pre-combustion chamber for providing pre-combustion chamber with a mixture of the oxidant gas and of a fuel, the swirler being arranged around the pre-combustion chamber in a circumferential direction with respect to a the centre axis, at least a pilot fuel injector for injecting a flow of pilot fuel into the combustor, The burner plenum is connected to the swirler and to the peripheral wall in such a way that a first portion of the oxidant gas from burner plenum is channelled to the swirler and a second portion of the oxidant gas is channelled to the passage. The pilot fuel injector is connected to the passage for injecting the flow of pilot fuel at an axial end of the passage.

The combustor may be an annular-type or a can-type combustor. The combustion chamber may have a cylindrical or oval shape. The combustion chamber may comprise a main combustion chamber and a pre-combustion chamber with a swirler section. The centre axis of the pre-combustion chamber may be a symmetry line of the pre-combustion chamber. At the swirler section, the swirler is mounted to the pre-combustion chamber and surrounds the pre-combustion chamber centre axis.

Advantageously, this allows the pilot gas injection to be assisted by a flow of swirling air producing a marginally higher air/fuel ratio in the diffusion flame compared to known pilot gas injection systems. This, thanks to the turbulence of the swirling air, enhances the reduction in emissions of NOx and provides a more stable combustion at wide load range.

According to possible embodiments, the second portion of flow of oxidant gas flowing in the passage along the pre-combustion peripheral wall may be comprised between 10% to 50% of the total flow of oxidant gas coming from the plenum towards the swirler and the passage. More particularly, such a portion may be the 30% of the total flow of oxidant gas to the swirler and to the passage.

Further, injecting the flow of pilot fuel at the axial end of the passage between the inner panel and the outer panel of the pre-combustion chamber wall moves the heat release from the pilot burner face towards more inner areas of the combustor.

As a result, temperature at the pilot burner surface is reduced, up to more acceptable values, which increases life of the pilot burner.

Advantageously, the diffusion flames from the pilot fuel injector are moved away from the pilot burner face towards more inner areas of the combustor. Consequently the premixed flames of the main fuel streamlines from the swirler are located more inside the pre-combustion chamber, again with the positive effect of moving flames and high temperature fluid zones away from the pilot burner face.

According to possible embodiments of the present invention, the combustor comprises a plurality of injectors, regularly distributed around the centre axis, for regularly distributing around the centre axis the diffusion flames from the pilot fuel and the main fuel streamlines from the swirler. In particular, the number of injectors may be between 9 and 12. More in particular, odd number of injectors is advantageous for suppressing the combustion dynamics from premixed flame in the region of the injectors.

According to possible embodiments of the present invention, the plurality of injectors is connected to a respective plurality of manifolds, the manifolds being connected to a common annular passage connecting the manifolds with a common source of pilot fuel.

Advantageously, through the common annular passage, concentric with the centre axis of the pre-combustion chamber, the pilot fuel is distributed uniformly to the pluralities of manifold and injectors.

BRIEF DESCRIPTION OF THE DRAWINGS

The aspects defined above and further aspects of the present invention are apparent from the examples of embodiment to be described hereinafter and are explained with reference to the examples of embodiment. The invention will be described in more detail hereinafter with reference to examples of embodiment but to which the invention is not limited.

DETAILED DESCRIPTION

Figure 1:
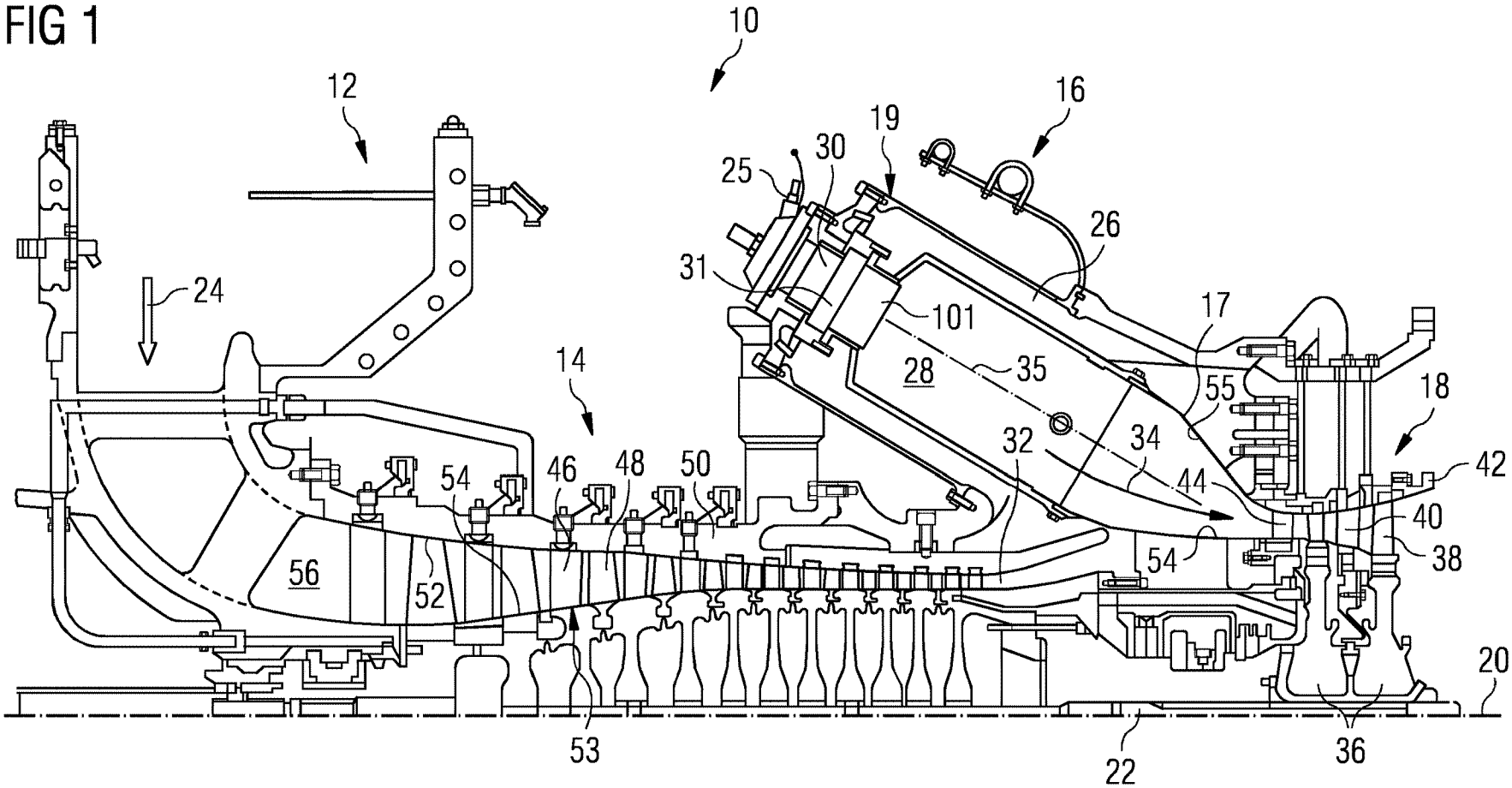
FIG. 1 shows a longitudinal sectional view of a gas turbine engine including a combustor according to the present invention.

The illustrations in the drawings are schematic. It is noted that in different figures, similar or identical elements are provided with the same reference signs.

FIG. 1 shows an example of a gas turbine engine 10 in a sectional view. The gas turbine engine 10 comprises, in flow series, an inlet 12, a compressor section 14, a burner section 16 and a turbine section 18 which are generally arranged in flow series and generally about and in the direction of a longitudinal or rotational axis 20. The gas turbine engine 10 further comprises a shaft 22 which is rotatable about the rotational axis 20 and which extends longitudinally through the gas turbine engine 10. The shaft 22 drivingly connects the turbine section 18 to the compressor section 14.

In operation of the gas turbine engine 10, an oxidant gas 24, for example air, which is taken in through the air inlet 12 is compressed by the compressor section 14 and delivered to the combustion section or burner section 16.

The burner section 16 comprises a burner plenum 26, one or more combustion chambers 28, each having a respective upstream pre-combustion chamber 101. The burner section 16 further comprises at least one pilot burner 30 and a swirler section 31 fixed to each pre-combustion chamber 101. The pre-combustion chambers 101, the combustion chambers 28, the pilot burners 30 and the swirler section 31 are located inside the burner plenum 26. The compressed air passing through the compressor 14 enters a diffuser 32 and is discharged from the diffuser 32 into the burner plenum 26. A portion of the air coming from the burner plenum 26 is mixed with a gaseous or liquid pilot fuel. The air/fuel mixture is then burned and the combustion gas 34 or working gas from the combustion is channelled through the combustion chamber 28 to the turbine section 18 via a transition duct 17.

A main flow of air/fuel mixture is inserted in the pre-combustion chamber 101 through the swirler section 31, as better detailed in a following section of the present text. The main fuel burns when mixing with the hot gasses in the pre-combustion chamber 101 and in the main combustor chamber 28.

This exemplary gas turbine engine 10 has a cannular combustor section arrangement, which is constituted by an annular array of combustor cans 19 each having a pilot burner 30 and a combustion chamber 28, the transition duct 17 having a generally circular inlet that interfaces with the combustor chamber 28 and an outlet in the form of an annular segment.

An annular array of transition duct outlets form an annulus for channelling the combustion gases to the turbine 18.

The turbine section 18 comprises a number of blade carrying discs 36 attached to the shaft 22. In the present example, two discs 36 each carry an annular array of turbine blades 38. However, the number of blade carrying discs could be different, i.e. only one disc or more than two discs. In addition, guiding vanes 40, which are fixed to a stator 42 of the gas turbine engine 10, are disposed between the stages of annular arrays of turbine blades 38. Between the exit of the combustion chamber 28 and the leading turbine blades 38 inlet guiding vanes 44 are provided and turn the flow of working gas onto the turbine blades 38.

The combustion gas from the combustion chamber 28 enters the turbine section 18 and drives the turbine blades 38 which in turn rotate the shaft 22. The guiding vanes 40, 44 serve to optimise the angle of the combustion or working gas on the turbine blades 38.

The turbine section 18 drives the compressor section 14. The compressor section 14 comprises an axial series of vane stages 46 and rotor blade stages 48. The rotor blade stages 48 comprise a rotor disc supporting an annular array of blades. The compressor section 14 also comprises a casing 50 that surrounds the rotor stages and supports the vane stages 48. The guide vane stages include an annular array of radially extending vanes that are mounted to the casing 50. The vanes are provided to present gas flow at an optimal angle for the blades at a given engine operational point. Some of the guide vane stages have variable vanes, where the angle of the vanes, about their own longitudinal axis, can be adjusted for angle according to air flow characteristics that can occur at different engine operations conditions.

The casing 50 defines a radially outer surface 52 of the passage 56 of the compressor 14. A radially inner surface 54 of the passage 56 is at least partly defined by a rotor drum 53 of the rotor which is partly defined by the annular array of blades 48.

The present invention is described with reference to the above exemplary turbine engine having a single shaft or spool connecting a single, multi-stage compressor and a single, one or more stage turbine. However, it should be appreciated that the present invention is equally applicable to two or three shaft engines and which can be used for industrial, aero or marine applications.

The terms upstream and downstream refer to the flow direction of the airflow and/or working gas flow through the engine unless otherwise stated. When not differently specified, the terms axial, radial and circumferential are made with reference to an axis 35 of the combustor.

Figure 2:
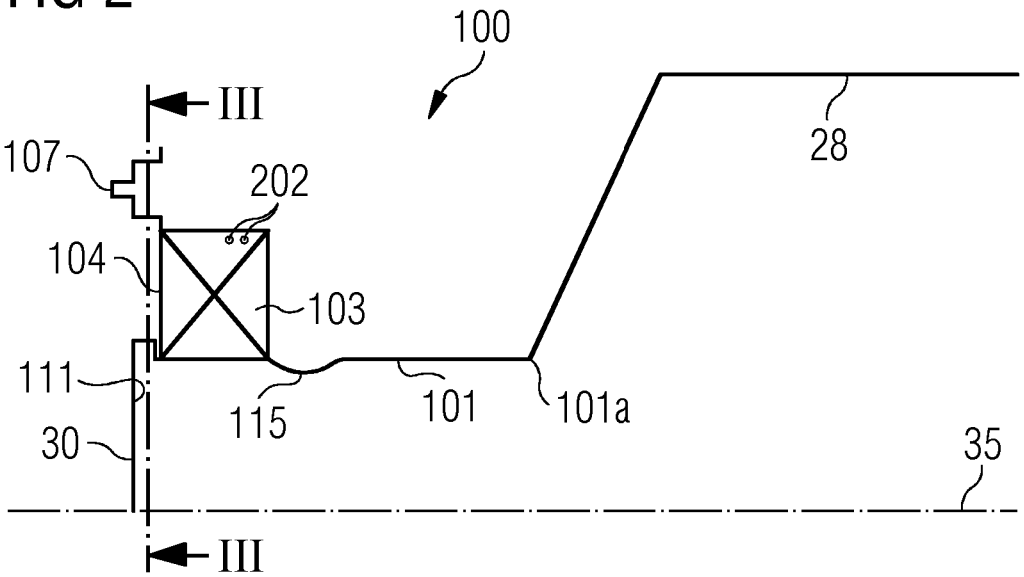
FIG. 2 shows a partial and schematic longitudinal section of a combustor arrangement for a gas turbine according to an exemplary embodiment of the present invention, showing a pilot burner, a pre-chamber and a swirler section.

FIG. 2 shows a combustor 100 for a gas turbine. The combustor 100 has a centre axis 35 and comprises:—an upstream portion with a pre-combustion chamber 101 and a swirler 103, and—a downstream portion with a combustion chamber 28.

The pre-combustion chamber 101, the swirler 103 and the combustion chamber 28 are all axially symmetric around the centre axis 35. With respect to the centre axis 35, the pre-combustion chamber 101 has a smaller diameter than the combustion chamber 28. The pre-combustion chamber 101 and the combustion chamber 28 are adjacent to one another along the centre axis 35 and in fluid communication with one another. Downstream of the pre-combustion chamber 101 the combustion chamber 28 extends up to the transition duct 17. The combustion chamber 28 is conventional and therefore not described in further detail.

The swirler 103 is mounted on a peripheral wall 115 of the pre-combustion chamber 101, in such a way that the swirler 103 surrounds the pre-combustion chamber 101 in a circumferential direction with respect to the centre axis 35. The swirler receives a first flow F1 of the oxidant gas from the burner plenum 26 and mixes it with a fuel before injecting it into the pre-combustion chamber 101. The swirler 103 comprises a bottom surface 104 which is orthogonal to the centre axis 35 and which forms a part of a slot 201 (see FIG. 3) through which, typically, an oxidant/fuel mixture flow is injectable into the pre-combustion chamber 101.

Figure 3:
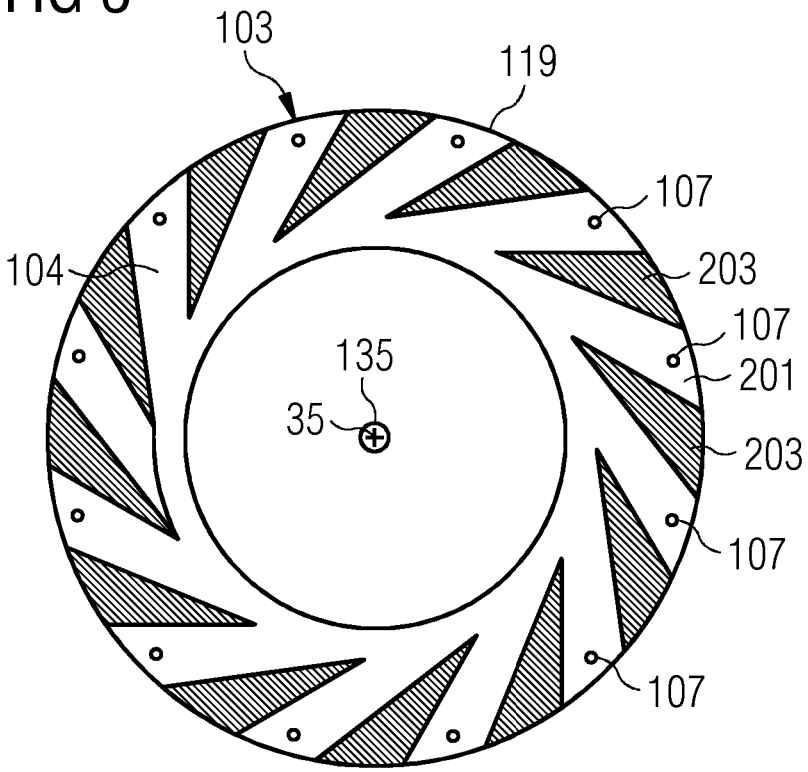
FIG. 3 shows a sectional view of a swirler according to exemplary embodiments of the present invention, according to the section line III-III (of FIG. 2.

The swirler 103 further comprises a cylindrical peripheral surface 119 having axis coincident with the combustor centre axis 35, With reference to FIG. 3, the swirler 103 comprises a plurality of slots 201 (twelve slots in the embodiment of FIG. 3). Each slot 201 is formed by circumferentially spaced apart vanes 203 and the bottom surface 104. Oxidant/fuel mixture which flows through the slots 201 is directed approximately tangentially with respect to the centre axis 35. This orientation of the slots 201 induces a swirl movement, i.e. a movement according to a tangentially orientated direction around the centre axis 35, of the gasses inside the pre-combustion chamber 101.

Each slot 201 comprises a base fuel injector 107 which is arranged to the bottom surface 104 such that an air/fuel mixture is injectable into the slot 201 according to a main fuel injection direction which is orthogonal or inclined with respect to the bottom surface 104.

Additionally, further side fuel injectors 202 may be provided for some of the slots 201 or for all of the slots 201 on the cylindrical peripheral surface 119 of the swirler 103.

In the embodiment of the attached figures two side fuel injectors 202 are provided for each of the slots 201.

The side fuel injectors 202 inject further fuel. The further fuel may be mixed inside the slots 201 with the fuel which is injected by the base fuel injector 107 and with the oxidant. Side fuel injectors 202 are in the form of holes, injecting further gaseous fuel.

According to other embodiments of the present invention, atomizers or nozzles for liquid fuel injection are provided in the same slots 201, close to the trailing edges of the swirler vanes 203.

Upstream to the swirler 103 and to the pre-combustion chamber 101, the combustor 100 further comprises the pilot burner 30, which comprises a burner face 111. In particular, the burner face 111 is aligned or substantially parallel to the bottom surface 104.

The pilot burner 30 comprises a pilot liquid fuel injector 135 which are arranged to the burner face 111 for injecting pilot liquid fuel into the pre-combustion chamber 101. The pilot liquid fuel injectors 135 are oriented substantially coaxial with the centre axis 35.

Figure 4A:
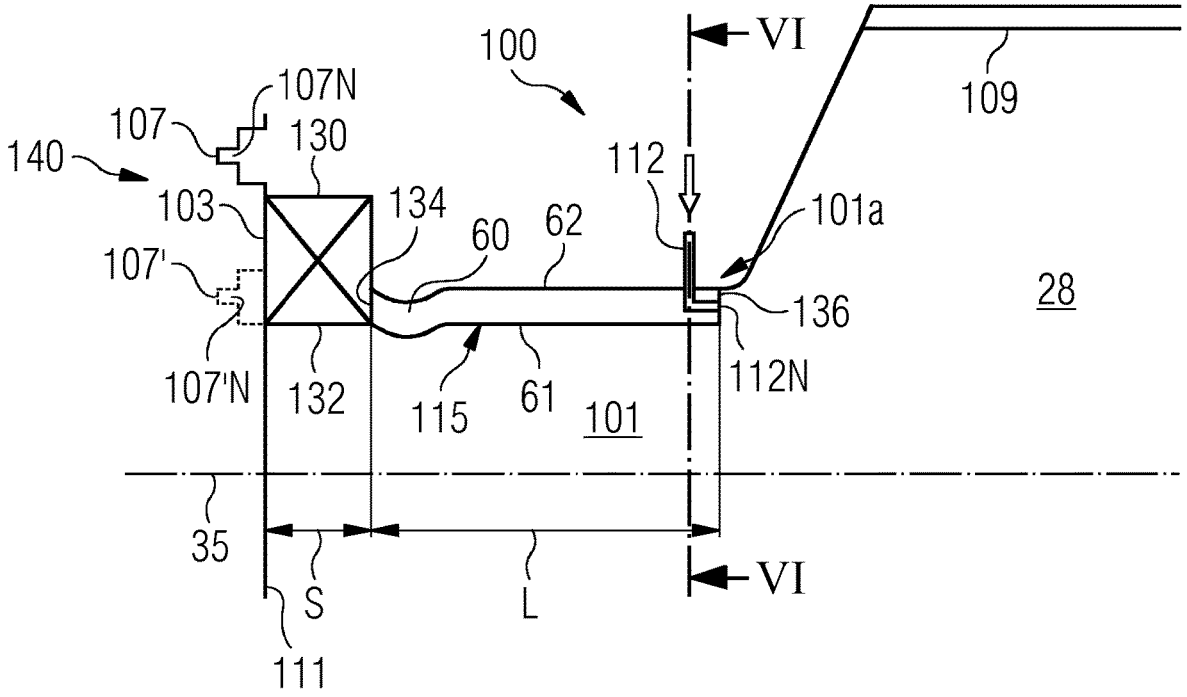
FIG. 4A derive from FIG. 2, showing in more detail some components of the combustor of the present invention.
Figure 5A:
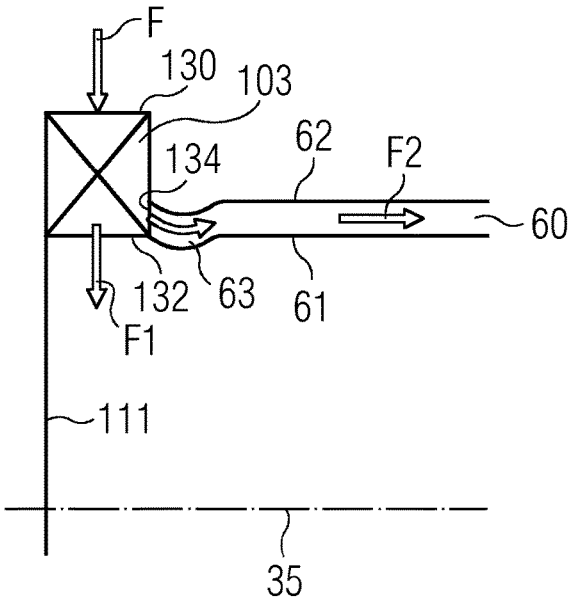
FIG. 5A derive from FIG. 2, showing in more detail some components of the combustor arrangement of the present invention.
Figure 5B:
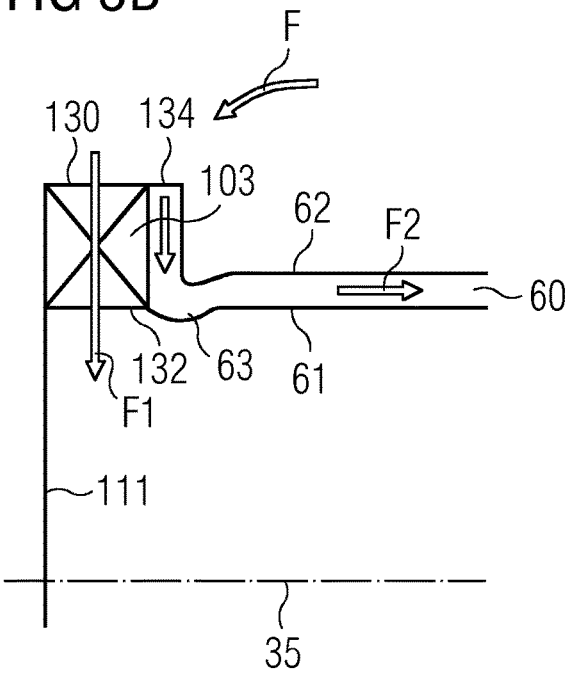
FIG. 5B shows an alternative embodiment of the combustor arrangement.
Figure 6:
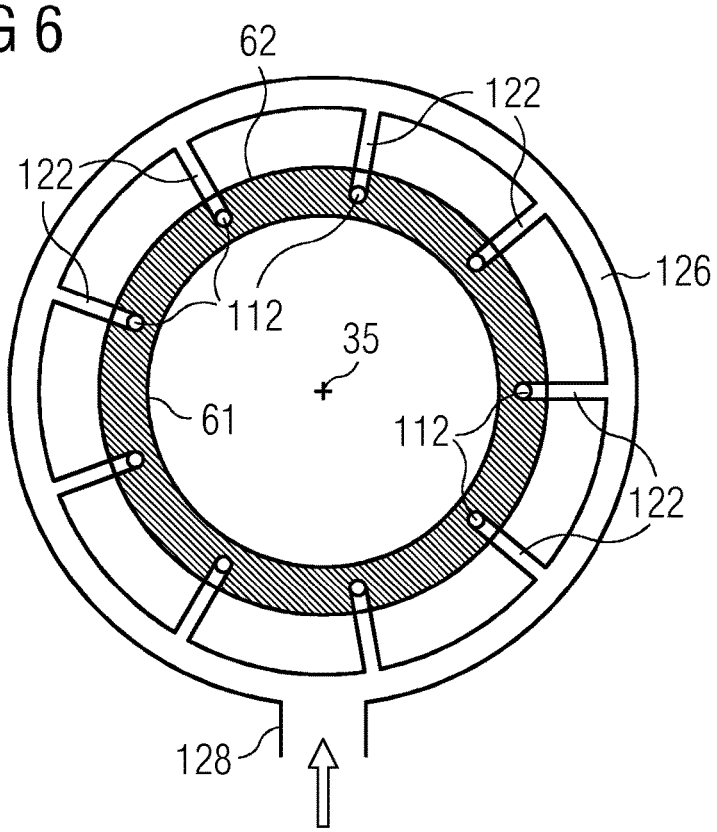
FIG. 6 shows a sectional view of the combustor of the present invention of FIG. 5, according to the section line VI-VI of FIG. 4.

With reference to FIGS. 4 to 6, the peripheral wall 115 comprising an inner panel 61 and an outer panel 62 distanced from the inner panel 61 in such a way that a passage 60 is provided the inner and the outer panels 61, 62. The passage 60 extends axially along the peripheral wall 115 from the swirler 103 up to an axial end 101*a* of the pre-combustion chamber 101, where the pre-combustion chamber 101 is connected to the combustion chamber 28.

The burner plenum 26 is connected to the peripheral wall 115 in such a way that a second portion F2 of the oxidant gas is channelled to the passage 60. According to possible embodiments of the present invention, the second portion F2 of flow of oxidant gas in the passage 60 is between 10% to 50% of the total flow F of oxidant gas from burner plenum 26 towards the swirler 103 and the passage 60 (being F therefore the sum of F1 and F2). According to a specific embodiment of the present invention, the second portion F2 may be the 30% of the total flow F.

The combustor 100 comprises a plurality of injectors 112 regularly distributed around the centre axis 35, for injecting a flow of pilot fuel into the combustor 100. The pilot fuel injector 112 is connected to the passage 60 for injecting the flow of pilot fuel at an axial end 101*a* of the passage 60.

In the embodiment of the attached FIGS. 4 to 6, nine pilot fuel injector 112 are provided, placed at 32.5 degree increments around the axis 35.

According to other embodiments of the present invention, the number of the injectors 112 is different, in particular ten, or eleven or twelve injectors 112 regularly distributed around the centre axis Y may be provided. An odd number of injectors (nine or eleven) are advantageous for suppressing any combustion dynamics from the main premixed flames.

The plurality of injectors 112 are connected to a respective plurality of manifolds 122. The manifolds 122 are connected to a common annular passage 126, concentric with the centre axis 35, connecting the manifolds 122 with a common source 128 of pilot fuel, radially oriented with respect to the centre axis 35.

In a summary of the present combustor the swirler arrangement 140, the pre-chamber 101 and the combustion chamber 28 are arranged about the centre axis 35 and are arranged in axial sequence. In use the compressed air or other oxidant gas F flows into the combustor 100 in a general direction from the swirler arrangement 140 towards the combustion chamber 28 in other words in a direction from left to right on the figures. The total flow into the combustion system, from the compressor, comprises the flow F and an amount of compressed air used for cooling. The cooling flow can be approximately 30% of the total flow.

The swirler arrangement 140 comprises the swirler 103 and the main fuel injector 107. The swirler 103, which is a radial swirler in this example has an annular array of vanes 203 defining an annular array of passages 201 each of which has an inlet 130 and an outlet 132. In use, the first portion F1 of the oxidant gas F flows through the outlet(s) 132 of the swirler 103 mixing with a main fuel flow from the main fuel injector(s) 107. The mixture of air (oxidant) and fuel passes into and through the pre-chamber 101, where further mixing occurs. The main air/fuel mixture is forced to swirl about the centre axis 35 by virtue of the tangentially angled vanes 203. The main air/fuel mixture passes into the combustion chamber 28 where it is combusted. Combustion can also take place in the pre-chamber.

The pre-chamber 101 comprises a generally annular peripheral wall 115. The peripheral wall 115 is a double wall construction and has the inner panel 61 and the outer panel 62 that form the passage 60 therebetween. The passage 60 has an inlet 134 and an outlet 136.

The pilot fuel injector 112 and more specifically a nozzle 112N of the fuel injector 112 is located between the inner panel 61 and the outer panel 62 to inject a flow of pilot fuel into the combustion chamber 28. The second portion F2 of the oxidant gas F is channelled through the passage 60 and mixes with the pilot fuel flow from the pilot fuel injector's nozzle 112N.

The combustor arrangement 100 is advantageous because the pilot fuel injection, in this example gaseous fuel, is directly into the main combustion chamber 28 where the pilot flame heat release takes place. This new location of the pilot flame is away from the burner surface 111. In addition, the pilot flame has marginally higher air to fuel ratio compared to conventional pilot flames. This will enhance stable combustion at wide load ranges.

In an embodiment shown in FIG. 5A, the inlet 134 of the passage 60 is located between the inlet 130 and outlet 132 of the swirler 103. More precisely the inlet 134 is between the plane of the inlet 130 and the plane of the outlet 132 of the swirler. The oxidant gas flow F enters the inlet 130 of the swirler 103 where the second portion F2 flows into the inlet 134 of the passage 60. This leaves the first portion F1 to flow through the outlet 132 of the swirler 103. The main fuel injector 107 is located radially outward of the swirler 103, in this case immediately radially outward.

The main fuel is collected by the oxidant gas flow and forced along the vane passages 201 of the swirler. The inlet 134 is located in the vane passage 201 and in a surface opposite or facing the burner surface 111. The inlet 134 is at a radially innermost location of the vane passage 201. At this location and also further radially outward, the main fuel will not have penetrated fully across the flow of gas in the passages 201 and therefore no main fuel will pass into the inlet 134.

One inlet 134 is located in each passage 201 between circumferentially adjacent vanes 203, although it is possible for inlets 134 to be located in alternate passages 201 for example. The array of inlets 134 feed into the annular passage 60.

In an alternative embodiment shown in FIG. 5B, the inlet 134 of the passage 60 is separate from the swirler 103 such that the oxidant gas flow F is divided so that the first portion F1 flows into the inlet 130 of the swirler 103 and the second portion F2 flows into the inlet 134 of the passage 60. In other words, the passage 60 bypasses the swirler 103.

In this embodiment the inlet 134 can be either an array of discrete inlets leading to the annular passage 60 or the inlet 134 may be an annular or a number of circumferential segments feeding into the annular passage 60. Furthermore, the passage 60 may be divided into an array of circumferential segments.

For each embodiment shown in FIGS. 5A and 5B, the outlet 136 of the passage 60 is at the downstream end 101*a* of the pre-chamber 115. It is intended that the downstream end 101*a* also defines the end of the pre-chamber 101 and therefore immediately downstream of the end 101*a* is the combustion chamber 28.

The pre-chamber 115 has an axial length L and the pilot nozzle 112N of the fuel injector 112 is located at the downstream end 101*a* of the pre-chamber. However, the nozzle may be within 50% of L or more advantageously 10% of L from the downstream end 101*a* of the pre-chamber 115. Therefore, the nozzle 112N can be recessed into the passage 60 from the end 101*a*. Alternatively, the nozzle 112N can protrude or project from the end 101*a*. In both cases the oxidant gas flow F2 is arranged to impinge the pilot fuel flow and mix with the pilot fuel flow from the nozzle.

The pilot fuel and/or mixture of pilot fuel and the second portion F2 of oxidant gas is injected directly into the combustion chamber 28. That is to say this pilot fuel, typically a gas, is not injected into the pre-chamber 101. This direct injection in to the main combustion chamber 28 prevents the pilot flame forming in the pre-chamber 101 and heating the burner surface 111. The pilot flame is created solely in main combustion chamber 28 and provides a more stable flame with reduced emissions.

Figure 4B:
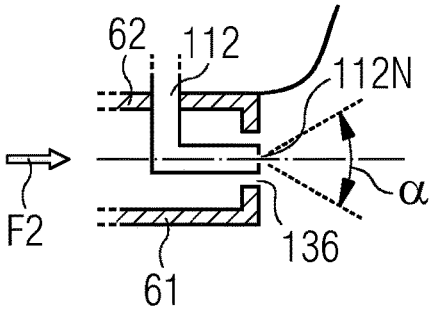
FIG. 4B shows further detail of the end of the pre-chamber.
Figure 4C:
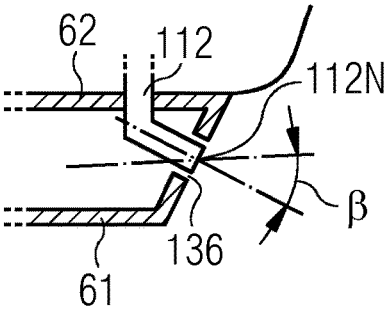
FIG. 4C shows an alternative embodiment of the end of the pre-chamber.

In FIG. 4B the pilot fuel emitted from the nozzle 112N can form a cone having an angle α. The angle α will depend on factors such as fuel density, viscosity, pressure, velocity and nozzle size and shape. The cone of fuel has a centre-line 113 and the centre-line is approximately parallel to the centre axis 35. However, in other embodiments such as shown in FIG. 4C, and depending on the fluid flows and combustion flames throughout the combustor it might be necessary to alter the angle of the fuel injector/nozzle such that the centre-line 113 is angled from a line parallel to the centre-axis 35. Typically, the pilot fuel and/or mixture of pilot fuel and the second portion F2 of oxidant gas may be injected at angle β of up to 45° from the centre axis 35. This injection angle β can be radially inwardly or radially outwardly with respect to the centre axis 35.

In addition, the pilot fuel and/or mixture of pilot fuel and the second portion F2 of oxidant gas is injected at a tangential angle of up to 45° into the combustion chamber 28. The tangential angle can be thought of as being into or out of the plane of the section shown in FIGS. 4A, 4B, 4C or even the paper. It is the angle of the fuel injector 112/nozzle 112N that is angled from the centre axis 35 to produce the tangential angle for the centre-line 113. Here the tangential angle may be clockwise or anti-clockwise about the axis 35 and is intended to help promote mixing of the fuel and pilot oxidant gas flow F2 and/or this mixture mixing with the main fuel/oxidant mixture within the main combustion chamber. The tangential angle promotes a swirling or rotating vortex of the pilot fuel/oxidant mixture and depending on the application may be rotating with or against the direction of rotation of the main fuel/oxidant mixture swirling through the pre-chamber and into the combustion chamber.

The main fuel injector 107 has a nozzle 107N that is located radially outward of the swirler 103 as shown in FIG. 4A, but alternatively the main fuel injector 107' has a nozzle 107'N that is located radially between the inlet 130 and outlet 132 of the swirler 103. The exact location of the main fuel injector 107, 107' is dependent on the flow characteristics of any combustor geometry suffice to say that for any location of the main fuel injector the fuel and oxidant produce a swirling mixture in the pre-chamber 101.

The pre-chamber 101 has a generally cylindrical shape having parallel wall or walls 115. As shown the pre-chamber 101 has a slight projection in surface into the main flow or restriction 63 which reduces the cross-sectional area and helps to control the position of the flame away from the burner surface 111. In other embodiments it is possible that the pre-chamber 101 has a shape that is at least partly divergent or convergent or any combination of parallel, divergent or convergent. These various shapes can promote control of where the flames are located within the combustor and depend on various factors such as fuel flows, fuel types, oxidant flows and geometry of other combustor components.

It should be noted that the term "comprising" does not exclude other elements or steps and "a" or "an" does not exclude a plurality. Also elements described in association with different embodiments may be combined. The term 'between' or 'therebetween' means that not only can something be situated anywhere from one extremity to the other, but it also means at or on those extremities. It should also be noted that reference signs in the claims should not be construed as limiting the scope of the claims.

The invention claimed is:

1. A combustor for a gas turbine, comprising:

generally arranged about a centre axis and in axial sequence a swirler arrangement, a pre-chamber and a combustion chamber, wherein in use an oxidant gas flows into the combustor in a general direction from the swirler arrangement towards the combustion chamber, wherein the swirler arrangement comprises a swirler and a main fuel injector, the swirler having an inlet and an outlet, and wherein in use a first portion of the oxidant gas flows through the outlet of the swirler mixing with a main fuel flow from the main fuel injector and passes into and through the pre-chamber to combust in the combustion chamber, wherein the pre-chamber comprises a generally annular peripheral wall, the peripheral wall comprising an inner panel and an outer panel forming a passage therebetween, the passage comprises an inlet and an outlet, and a pilot fuel injector located between the inner panel and the outer panel for injecting a flow of pilot fuel into the combustion chamber, wherein a second portion of the oxidant gas is channelled through the passage and mixes with a pilot fuel flow from the pilot fuel injector, wherein the inlet of the passage is located between the inlet and the outlet of the swirler, and wherein the oxidant gas flow enters the inlet of the swirler where the second portion flows into the inlet of the passage and the first portion flows through the outlet of the swirler.

2. The combustor according to claim 1, wherein the outlet of the passage is at a downstream end of the pre-chamber.

3. The combustor according to claim 1, wherein the pre-chamber has an axial length L, and wherein the pilot fuel injector has a nozzle, the nozzle is located within 50% of L.

4. The combustor according to claim 1, wherein the pilot fuel and/or mixture of pilot fuel and the second portion of oxidant gas is injected directly into the combustion chamber.

5. The combustor according to claim 1, wherein the pilot fuel and/or mixture of pilot fuel and the second portion of oxidant gas is injected at angle of up to 45° from the centre axis.

6. The combustor according to claim 1, wherein the pilot fuel and/or mixture of pilot fuel and the second portion of oxidant gas is injected at tangential angle of up to 45° into the combustion chamber.

7. The combustor according to claim 1, wherein the main fuel injector has a nozzle located radially outward of the swirler or radially between the inlet and the outlet of the swirler.

8. The combustor according to claim 1, wherein the pre-chamber having a shape defined by the peripheral wall being parallel, divergent, convergent or any combination of parallel, divergent or convergent.

9. The combustor according to claim 1, wherein the combustor comprises a plurality of pilot fuel injectors including the pilot fuel injector.

10. The combustor according to claim 9, wherein the plurality of pilot fuel injectors is connected to a respective manifold of a plurality of manifolds, the plurality of manifolds being connected to a common annular passage connecting the plurality of manifolds with a source of pilot fuel, the common annular passage being concentric with the centre axis.

11. The combustor according to claim 9, wherein a number of pilot fuel injectors of the plurality of pilot fuel injectors is between 9 and 12.

12. The combustor according to claim 1, wherein the second portion of oxidant gas in the passage is between 10% to 50% of the oxidant gas flow.

13. The combustor according to claim 1, further comprising: a pilot burner upstream of the pre-chamber which comprises a pilot burner surface separating the pilot burner from the pre-chamber, wherein the pilot burner comprises a liquid pilot fuel injector which is arranged to the pilot burner surface for injecting liquid pilot fuel into the pre-chamber.

14. The combustor according to claim 1, wherein the pre-chamber has an axial length L, and wherein the pilot fuel injector has a nozzle, the nozzle is located within 10% of L.

15. The combustor according to claim 1, wherein the pre-chamber comprises an axial length L, and wherein the pilot fuel injector comprises a nozzle, the nozzle is located at a downstream end of the pre-chamber.

16. The combustor according to claim 1, wherein the pilot fuel and/or mixture of pilot fuel and the second portion of oxidant gas is injected in an axial direction into the combustion chamber.

17. The combustor according to claim 1, wherein the combustor comprises a plurality of pilot fuel injectors including the pilot fuel injector, wherein the plurality of pilot fuel injectors are regularly distributed around the centre axis.

* * * * *